US005735507A

United States Patent [19]

Sierra Escudero et al.

[11] Patent Number: 5,735,507

[45] Date of Patent: Apr. 7, 1998

[54] SAFETY SYSTEM FOR HOIST APPARATUS

[75] Inventors: Emilio Sierra Escudero; José Sierra Escudero, both of Saragossa, Spain

[73] Assignee: Ganchos de Seguridad, S.L., Saragossa, Spain

[21] Appl. No.: 445,453

[22] Filed: May 30, 1995

[30] Foreign Application Priority Data

May 30, 1994 [ES] Spain ..... 9401183

[51] Int. Cl.[6] ..... B66D 3/06

[52] U.S. Cl. ..... 254/391

[58] Field of Search ..... 254/391, 272

[56] References Cited

U.S. PATENT DOCUMENTS

| | | | |
|---|---|---|---|
| 609,438 | 8/1898 | Kershaw | 254/391 |
| 811,440 | 1/1906 | Roberts | 254/391 |
| 1,116,434 | 11/1914 | Johansson | 254/391 |
| 1,714,452 | 5/1929 | Schat | 254/391 |
| 2,276,767 | 3/1942 | Dubuque . | |
| 3,887,038 | 6/1975 | Buschbom et al. | 254/272 |

FOREIGN PATENT DOCUMENTS

| | | | |
|---|---|---|---|
| 0155217 | 9/1985 | European Pat. Off. . | |
| 355701 | 12/1919 | Germany | 254/391 |
| 8908234 | 10/1989 | Germany . | |
| 5-278996 | 10/1993 | Japan | 254/272 |
| 154470 | 12/1920 | United Kingdom . | |
| 1402995 | 8/1975 | United Kingdom . | |

*Primary Examiner*—Katherine Matecki

*Attorney, Agent, or Firm*—Klauber & Jackson

[57] ABSTRACT

Safety system for hoist apparatus, used with all types of cranes employing a flexible element for the handling of a load, the device preventing the free fall of the load in the event of a flexible element rupture, where the flexible element (3) is conducted and guided in the interior of a housing, the system further comprising a pair of pulleys (4) and (5), tie-down mechanism capable of gripping the intact branches of the flexible element, and an activating mechanism which includes a latch, wherein in the normal working position, the flexible element freely circulates through the interior of the housing, and the latch (6) remains in a fixed position, and wherein the rupture of the flexible element displaces the latch, activating the system and gripping an intact portion of the flexible element with the tie-down mechanism.

40 Claims, 2 Drawing Sheets

SAFETY SYSTEM FOR HOIST APPARATUS

The present invention comprises a safety system for hoist apparatus, intended to be used on all types of machinery for hoisting, traction or transportation of materials, objects, animals or persons, in such a way that the elevating or traction body may be any type of flexible element which is capable of being gripped by a clutch, jaw or pincers.

The safety system can be used with all types of cranes for preventing the free fall of the load, in the event that the flexible elevating element or cable ruptures.

Thus, if the flexible element which elevates the load should suffer rupture, the safety system instantaneously activates, fixing the intact branches of the flexible element, thereby preventing the fall of the load into space and therefore the flexible element activates the safety element at the precise instant in which the rupture is produced.

BACKGROUND OF THE INVENTION

Cranes used for hoisting a variety of loads are well-known, and typically include a central pillar or vertical tower, an elevation arm joined to the tower, and a group of cables which run through the tower and pass through the upper end of the arm. The crane cables thus serve to elevate a load, but the cables are not equipped with any safety system which prevents the free fall of the load if the cable ruptures.

Thus, whenever the load attachment cable ruptures, the load falls irremedially into space, resulting in a loss of the load and a potential fatal accident for any persons located within the range of action of the crane and its load.

Typically, the machines for which the safety system of the present invention are intended, are not equipped with any safety mechanism whatsoever, therefore the loads manipulated by such machines are susceptible to falls or detachments from the attachment means or hook which connects the load to the machine.

Although prior devices may include some type of free fall prevention means, none of the prior devices includes an anti-rupture mechanism or safety system which prevents fails due to the rupture of the flexible element the hook and braking mechanisms of the prior devices, including their loads, would fall into space in the event of rupture of the flexible element.

DESCRIPTION OF THE INVENTION

A safety system is described herein for a hoist apparatus which is placed at the load attachment end of the hoist apparatus, the safety system comprising a closed body which houses the remaining elements of the safety mechanism. A flexible element also runs through the interior of the closed body.

The flexible element, which may include cables made of different materials, chains, tapes, branches, etc., may freely pass through a series of pulleys in the interior of the closed body. The closed body also houses a tie-down mechanism and a mechanism for activating the tie-down mechanism.

The flexible element is conducted through a series of pulleys, so that a pair of pulleys placed on the same horizontal plane causes a change of direction of the flexible element. An activating or release latch of the tie-down mechanism is disposed between the pair of pulleys.

The latch terminates at its bottom with a pulley. The lower horizontal section of the flexible element runs along the pulley. The pulley is biased by a tensile spring or spring carrier which is activated by the flexible element at the moment of its rupture.

The positioning latch of the clutches or jaws which constitute the flexible element apprehension mechanism, is maintained in an operating position during normal operation. The flexible element, upon rupturing, frees itself and releases the latch, thus activating the safety mechanism which detains the intact branch of the flexible element.

The safety mechanism comprises a pair of assemblies, each directed towards a vertical branch of the flexible element, and comprises a horizontal flat bar, through one of whose ends is joined the latch, and on whose central surface a gap is provided, which accommodates a pivot, while on its other end the horizontal flat bar joins rotationally to a pair of flat bars on the other end of which are rotationally attached clutches or attachment jaws capable of gripping the flexible element.

The said latches or jaws are equipped with a fixed rotational axis, and in relation to the rotational axis of the joint to the corresponding flat bar, are biased by a tensile spring or spring carrier, which impel the latches or jaws against the flexible element in order to effect attachment.

The apprehension jaws for gripping the flexible element, remain in a resting position adjacent to the flexible element and facing some concavities on the interior of the housing or body in the event that the flexible element ruptures, the jaws or clutches are activated and press the flexible element against the concavities. Thus, the gripping of the intact branches of the flexible element prevents the fall of a load wherein the actual weight supported and the eccentricity built into the safety assembly results in a greater pressure exerted against the flexible element for greater load weights.

To complement the following description, and with the object of facilitating a better comprehension of its characteristics, figures are presented as non-limitative illustrations of the main features of the invention, described herein.

DESCRIPTION OF A PREFERED EMBODIMENT

Figure 1:
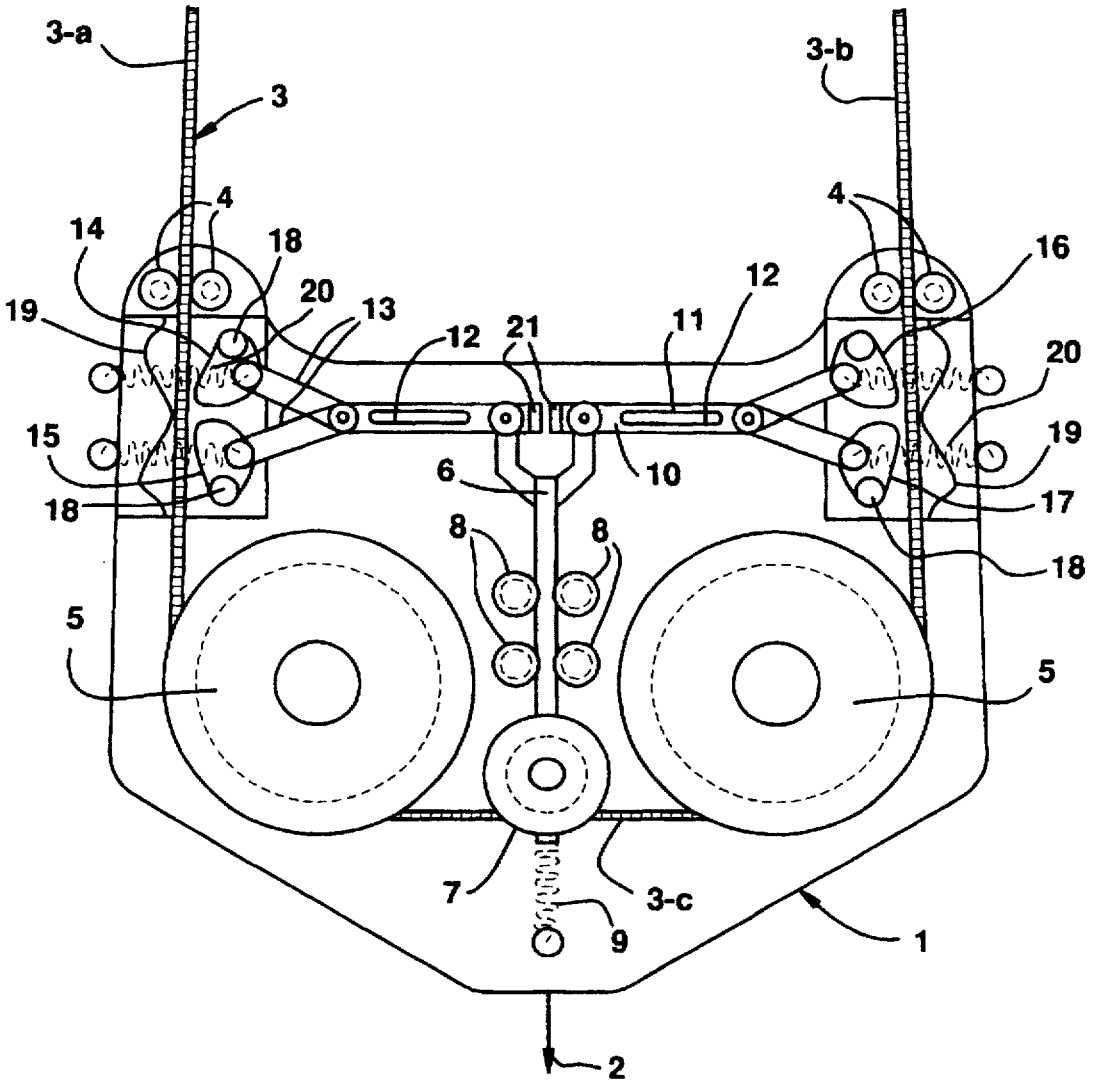
FIG. 1 represents a cutaway side elevational view of the safety mechanism for use with a hoist apparatus comprising a tie-down mechanism and an activating or release mechanism in a normal working position, in which the flexible element runs freely throughout its interior guided by a series of pulleys.

In view of the described figures and according to the adopted numbering, we can observe how the safety system for hoist apparatus is constituted by a housing 1 inside of which is housed all the constituting elements of the system, and which shall be equipped with the corresponding tie-down hooking 2 of the load.

Housing 1 is placed at the free end of hoisting cable 3, the cable passing completely therethrough, i.e. passing inside the housing 1, being guided by corresponding pulleys 4 which guide the cable and by a pair of pulleys 5 which change the direction of the cable, wherein cable 3 passes freely during normal operation of the apparatus.

The safety system is basically made up of the tie-down mechanism and the release mechanism of the same, in such a way that the release mechanism comprises a latch 6, joined at the bottom to pulley 7 which is in contact with lower section 3-*c* of cable 3 and which is biased by the coil spring, spring carrier or tensile spring 9.

Likewise, latch 6 remains guided by pulleys 8, and by its end opposite to its rotational joint to pulley 7, is operatively connected to the tie-down mechanism, in order to maintain the tie-down mechanism in position during normal working operation of the apparatus.

The tie-down mechanism comprises two assemblies of elements which act in relation to each one of the parallel branches 3-*a* and 3-*b* of the flexible element or cable 3, said assemblies remaining in transversal direction to the passage of the respective vertical branches.

In anticipation of rupture, each one of the tie-down assemblies which may grip one of the intact branches comprises a flat bar 10 which remains in position by means of latch 6, said flat bar 10 being provided with a longitudinal gap 11 in which is housed a fixed pivot 12, in such a way that during the displacement of the flat bar 10, said pivot 12 acts as guide.

On the other end, flat bar 10 remains joined rotationally to a pair of flat bars 13 which are likewise rotationally joined to respective jaws which in turn are rotationally joined to a fixed axis 18 of the housing 1.

The tie-down or apprehension jaws of the branches of the flexible element 3, remain facing corresponding concavities 19 formed on housing 1, in such a way that on activation of the tie-down mechanism, as the jaws press down on the flexible element on the confronted cavities, and because of the eccentricity formed by pivot 12 with the two rotational axes 18 and 19 of the jaws, the greater the weight of the load, the greater the pressure exerted by the jaws on the imprisoned flexible element.

Thus, when one of the branches 3-*a*, 3-*b* or 3-*c* breaks, the actual flexible element 3 activates the coil spring 9, and latch 6 is displaced, freeing the pair of flat bars 10 of the tie-down mechanism, so that when the flat bars 10 are free of latch 6, they are displaced, guided by pivot 12 or by the action of the coil springs, tensile springs or spring carriers 20 which act on the tie-down jaws of the flexible element 3, causing the corresponding pair of jaws to tie-down onto an intact branch of the flexible element.

Figure 2:
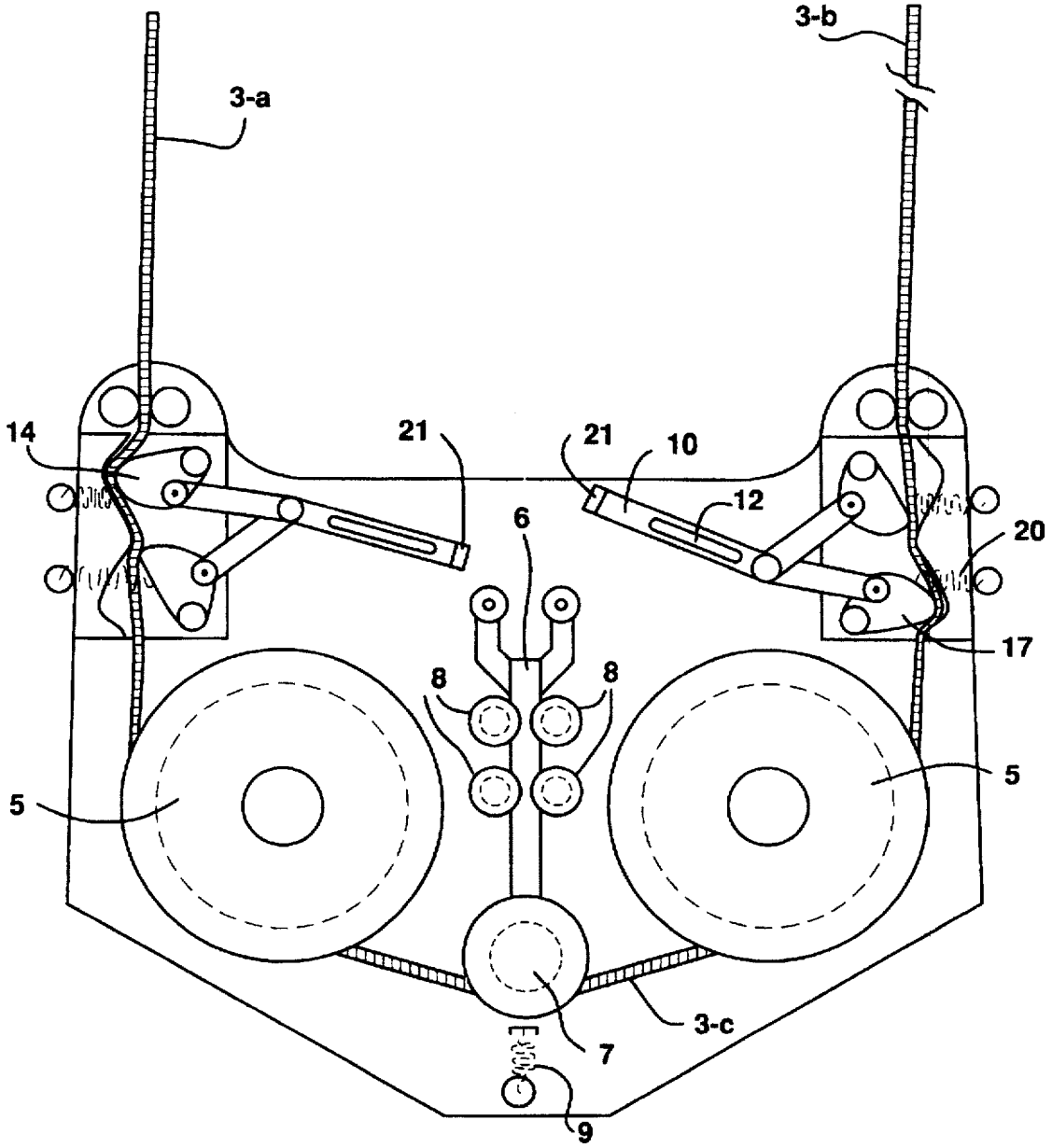
FIG. 2 represents a cutaway side elevational view of FIG. 1, in which the safety mechanism is activated, pressing against the corresponding clutches of the intact branches of the flexible element, preventing the fall of the load.

Specifically, if branch 3-b breaks as seen in FIG. 2, jaws 14 and 17 imprison the intact branch of flexible element 3 against the respective facing concavities 19, thereby preventing the load from falling into space together with housing 1.

If on the contrary, branch 3-a breaks, jaws 15 and 16 shall imprison the intact branch of flexible element 3 against the respective facing concavities 19, similarly preventing the falling of the load.

If the flexible element should break at branch 3-c, jaws 14 and 16 would imprison the intact branch of flexible element 3 against respective facing concavities 19, avoiding the Ires fall of the load.

As seen in FIGS. 1 and 2, each flat bar (10) is provided with a bent end portion which is illustrated by the darkly shaded area at the inner, or central, or first end of each flat bar. The end portion is bent toward the latch means (6) at approximately 90 degrees from the rest of the flat bar (10). The end of the latch (6) opposite the end which engages the pulley (7) is provided with a forked portion having two prongs. As best seen in FIG. 2, at the distal end of each prong is a pulley or wheel which engages the bent end portion of a respective flat bar 10. The wheel engages the flat bar (10) and is biased thereagainst by springs (20) when the latch (6) is in a first position, as seen in FIG. 1. As seen in FIG. 2, when the latch (6) moves into a second position, the wheels of latch (6) roll past the flat bars (10) and thereby disengage. Thus, the wheels facilitate the movement of the latch (6) with respect to the flat bars (10) upon actuation.

Thus, the following points may be noted about the present invention:

- the actual flexible element directly activates the safety system at the moment rupture occurs on any of the branches of the flexible element;
- the actuation of the safety system is effected at the very moment in which rupture of the flexible element is produced, since the flexible activates it, providing a total reliablity to the system considering its time of actuation to be within one thousandths of a second to one and a half seconds, otherwise if the time of activation were over two seconds, the system would not be effective at all, and the load would fall the moment the flexible element broke;
- the displacement trajectory of the system 1, with or without load, during the time interval the moment in which the flexible element breaks and the moment in which the system is activated and preventing the free fall of the load, must be a maximum of two meters in order to be effective, otherwise, the load would inevitably fall; because the tie-down system of the jaws acts at the actual moment of rupture of the flexible element, and because the flexible element activates the system, the displacement of the system will in no case reach two meters, with or without load, and as such the safety system described is totally reliable.

Finally, emphasis should be given to the great advantages provided by the present system, where, because the device prevents the falling of loads which are being manipulated by the hoisting apparatus if the attaching flexible element should break, not only are material losses prevented, but possibly fatal accidents may be prevented for those persons who might be within the range of influence falling of the load.

As described herein, reference has been made to a flexible element having two vertical branches, when said element, due to requirements of the machine or of its load, is made up of more than two branches, the system shall be equipped with the necessary jaws, clutches or pincers, and shall be disposed in a suitable manner which will ensure the adequate performance of the safety system.

We claim:

1. A safety device for a hoist apparatus which includes a flexible element (3) to hoist a load, said device comprising:

a housing (1);

hooking means (2) disposed on said housing for connecting the device to a load;

trajectory definition means (4, 5) disposed inside said housing (1) for defining a trajectory of the flexible element (3) passing through said housing (1), said trajectory definition means (4, 5) including a pair of lower pulleys (5) disposed such that the trajectory of the flexible element (3) through said housing (1) during operation comprises a first, substantially vertical, branch (3*a*), a second, substantially horizontal, branch (3*c*), and a third, substantially vertical, branch (3*b*);

first locking means (10, 13–17) disposed within said housing and displaceable between an open position and a locking position;

second locking means (19) situated within said housing (1), wherein said first locking means (10, 13–17) and second locking means (19) define gaps therebetween which are adapted to allow the flexible element (3) to pass therethrough when the flexible element is intact, wherein the flexible element (3) can move freely through said gaps when said first locking means is in the open position, and wherein a portion of the flexible element (3) is locked between the first locking means (10, 13–17) and the second locking means (19) when said first locking means is in the locking position;

a latch means (6) displaceable between a first position and a second position and disposed within said housing (1) for maintaining the first locking means (10, 13–17) in the open position while the latch means (6) remains in the first position and the flexible element remains intact;

first activation means (7, 9) for moving the latch means (6) from the first position to the second position when the flexible element (3) ruptures, including support means (7) for keeping the latch means (6) in a first position; and second activation means (20) for displacing the first locking means (10, 13–17) to the locking position when the latch means (6) is displaced from the first position towards the second position.

2. The device according to claim 1, wherein the second locking means (19) comprises fixed stop surfaces fixedly attached to said housing and wherein the first locking means (10, 13–17) comprises corresponding surfaces which face the fixed stop surfaces.

3. The device according to claim 1, wherein said device further comprises a guiding means (8) for guiding the movement of said latch means wherein the latch means comprises a latch having an elongated part, an upper part for contacting the first locking means (10, 13–17), and a lower part connected to the first activation means.

4. The device according to claim 3, wherein said support means (7) comprises pulley means joined to the lower part of the latch (6) for contacting the flexible element (3); and wherein said first activation means (7, 9) further comprises actuation means (9) connected to said pulley means for exerting a downward force on said pulley means.

5. The device according to claim 4, wherein said pulley means comprises a pulley, wherein the actuation means comprises a spring means, and wherein said guiding means (8) comprises at least four pulleys.

6. The device according to claim 3, wherein the jaws (14) and the second locking means each comprise mutual stop surfaces, wherein the jaws (14–17) and the second locking means are capable of gripping the flexible element between the mutual stop surfaces and transmitting the tension encountered in the flexible element into movement of the jaws towards the second locking means.

7. The device according to claim 1, wherein the first locking means (10, 13–17) comprises first and second flat bars (10), said flat bars being movably connected to the housing (1).

8. The device according to claim 7, wherein each of said flat bars comprises a longitudinal gap (11), and wherein said device further comprises fixed pivots (12) joined to said housing, said pivots being fit within said longitudinal gaps (11).

9. The device according to claim 1, wherein said device further comprises at least two fixed axes joined to said housing, and wherein the first locking means (10, 13–17) comprises at least one flat bar (10) and at least two jaws (14–17) connected rotationally to the housing by said fixed axes (18), each jaw (14–17) being connected to the flat bar (10) and to the second activation means (20), wherein the jaws are adapted to stop against the second locking means (19).

10. The device according to claim 9, wherein said second locking means comprises:

a first lateral part having a surface with upper and lower parts, and a second lateral part having a surface with upper and lower parts, wherein said device further comprises third flat bars, wherein the first locking means (10, 13–17) includes four jaws (14–17), wherein two of said four jaws are connected to the first flat bar (10) and the other two of said fob jaws are connected to the second flat bar (10) by said third flat bars (13), wherein the four jaws (14–17) include:

a first jaw (14) wherein the first jaw stops against the upper part of the surface of said first lateral part of said second locking means (19) when said first jaw is in the locking position;

a second jaw (16) wherein the second jaw stops against the upper part of the surface of said second lateral part of said second locking means (19) when said second jaw is in the locking position;

a third jaw (15) wherein the third jaw stops against the lower part of the surface of said first lateral part of said second locking means (19) when said third jaw is in the locking position; and a fourth jaw (17) capable of assuming a stop position wherein the fourth jaw stops against the lower part of the surface of said second lateral part of said second locking means (19) when said fourth jaw is in the locking position.

11. The device according to claim 10, wherein the second activation means further comprises spring means attached to the four jaws (14–17).

12. A system according to any of the previous claims, in which the first activation means is activated by the rupture of the flexible element (3).

13. A system according to claim 1, wherein the trajectory definition means (4, 5) comprises two lower pulleys (5) wherein the first activation means (7, 9) and the latch means (6) are disposed between said lower pulleys (5).

14. A safety device according to claim 1, wherein said device further comprises a plurality of pairs of pulleys (8) rotatably connected to said housing;

wherein said latch means (6) comprises a latch having an upper end, a lower end, and a middle part disposed between said pairs of pulleys and vertically displaceable therein, wherein the upper end engages the first locking means (10, 13–17), wherein the first locking means is maintained in the open position while the latch means (6) remains in the first position;

wherein said support means (7) comprises a pulley which is rotatably connected to the lower end of said latch, said pulley contacting the horizontal branch (3c) of the flexible element (3) during normal operation of the device;

wherein the first activation means (7, 9) farther comprises a spring element, said spring element being situated below said pulley and biasing said pulley downwards; and wherein said spring element is actuated when the flexible element ruptures.

15. A safety device according to claim 1, wherein said device further comprises four fixed rotation axes and four pivotable bars, each pivotable bar having first and second ends;

wherein said housing comprises at least two fixed pivots;

wherein the first locking means comprises two flat bars (10) and four jaws;

wherein each flat bar has a first end and a second end, the first end contacting the latch means while the latch means is in the open position;

wherein each flat bar has a longitudinal gap (1) which accommodates one of the fixed pivots (12), thereby providing guided movement of said flat bars (10);

wherein the second end of each of said flat bars is rotatably connected to the first end of each of two of said pivotable bars (13);

wherein the second end of each of said third flat bars is rotatably connected to one respective said jaw (14–17);

wherein each jaw (14–17) is rotatably connected to the housing (1) by a respective fixed rotation axis (18);

wherein said second locking means (19) includes concave surfaces;

wherein each jaw (14–17) is connected to said housing by a spring;

wherein each jaw (14–17) is disposed facing a corresponding concave surface on said second locking means (19), each jaw (14–17) being biased towards said corresponding concave surface of said second locking means (19) by said spring; and wherein said spring is connected to an axis joining the jaw (14–17) to the corresponding pivotable bar (13).

16. A safety device according to claim 1, wherein the first activation means (7, 9) further comprises a spring, wherein said spring displaces the latch element (6) from the first position to the second position when the flexible element (3) ruptures.

17. A safety device for use with a hoist apparatus having a flexible element for hoisting a load, said safety device comprising:

a housing;

hooking means disposed on said housing for connecting the load to the device;

mobile locking means disposed within said housing, wherein said mobile locking means is displaceable between an open position and a locking position;

second locking means fixedly situated within said housing, wherein said mobile locking means and second locking means are disposed in relation to each other so as to define gaps therebetween which accommodate the flexible element, wherein the gaps permit the flexible element to move freely therethrough when said mobile locking means is in the open position and wherein said device prevents the flexible element from moving freely through said gaps when said mobile locking means is in the locking position;

latch means for maintaining the mobile locking means in the open position when said latch means is in a first position, and for allowing the movable locking means to assume the locking position when said latch means is displaced from the first position;

first activation means for maintaining the latch means in the first position and for displacing the latch means from the first position when the flexible element ruptures;

second activation means for displacing the movable locking means into the locking position when the latch means is displaced from the first position; and trajectory definition means for guiding the flexible element through the interior of the housing so as to define a path for the flexible element which passes into said housing, through the gaps between said movable locking means and second locking means and in contact with said first activation means.

18. The device according to claim 17, wherein said latch means comprises a latch having:

an elongated portion;

an upper portion for releasably engaging said mobile locking means; and a lower portion connected to said first activation means.

19. The device according to claim 18 wherein said mobile locking means comprises:

first and second horizontal bars, which are substantially horizontal when the latch means is in the first position, each horizontal bar having one end releasably attached to respective opposite sides of the upper portion of said latch, and each horizontal bar having a longitudinal slot disposed between the one end and an opposite end of the horizontal bar;

first and second pivots fixedly attached to said housing wherein said pivots are adapted to fit within the longitudinal slot of said horizontal bars; and jaws disposed at the opposite end of each said horizontal bar.

20. The device according to claim 19 wherein said second activation means comprises a jaw biasing means connected to said jaws for biasing said jaws toward said second locking means.

21. The device according to claim 20 wherein said jaw biasing means comprises spring means.

22. The device according to claim 19 wherein said jaws comprise:

first and second pairs of bars attached to the opposite end of respective said first and second horizontal bars; and first and second pairs of jaws attached to respective said pairs of bars substantially opposite the respective attachments between said pairs of bars and said horizontal bar.

23. The device according to claim 22 wherein said mobile locking means further comprises first and second pairs of pivots fixedly attached to said housing, and wherein each of said jaws is adapted to pivotally mount to a respective said pivot.

24. The device according to claim 22 wherein said second locking means comprises:

a first stopping surface disposed in proximity with said first pair of jaws, said first stopping surface having an upper lateral portion and a lower lateral portion; and a second stopping surface disposed in proximity with said second pair of jaws, said second stopping surface having an upper lateral portion and a lower lateral portion.

25. The device according to claim 24 wherein said first pair of jaws comprises:

an upper jaw having an upper lateral portion adapted to mate with the upper lateral portion of said first stopping surface; and a lower jaw having a lower lateral portion adapted to mate with the lower lateral portion of said first stopping surface; and wherein said second pair of jaws comprises:

an upper jaw having an upper lateral portion adapted to mate with the upper lateral portion of said second stopping surface; and a lower jaw having a lower lateral portion adapted to mate with the lower lateral portion of said second stopping surface.

26. The device according to claim 25 wherein the upper lateral portion of said upper jaw of said first pair of jaws presses the first substantially vertical branch of the flexible element against the upper lateral portion of said first stopping surface when the flexible element ruptures and the first substantially vertical branch advances vertically upward with respect to said housing.

27. The device according to claim 25 wherein the lower lateral portion of said first upper jaw of said first pair of jaws presses the first substantially vertical branch of the flexible element against the lower lateral portion of said first stopping surface when the flexible element ruptures and the first substantially vertical branch advances vertically downward with respect to said housing.

28. The device according to claim 25 wherein the upper lateral portion of said upper jaw of said second pair of jaws presses the second substantially vertical branch of the flexible element against the upper lateral portion of said second stopping surface when the flexible element ruptures and the second substantially vertical branch advances vertically upward with respect to said housing.

29. The device according to claim 25 wherein the lower lateral portion of said upper jaw of said second pair of jaws presses the second substantially vertical branch of the flexible element against the lower lateral portion of said second stopping surface when the flexible element ruptures and the second substantially vertical branch advances vertically downward with respect to said housing.

30. The device according to claim 22 wherein said first and second pairs of jaws are rotatably connected to respective said first and second pairs of bars.

31. The device according to claim 22 wherein the first and second pairs of bars are rotatably connected to respective first and second pairs of horizontal bars.

32. The device according to claim 18 further comprising a guiding means for guiding the movement of said latch means in a substantially vertical direction.

33. The device according to claim 32 wherein said guiding means comprises a plurality of pulleys.

34. The device according to claim 33 wherein said guiding means further comprises a plurality of pairs of pulleys disposed on opposite sides of the elongated portion of said latch.

35. The device according to claim 18 wherein said trajectory means comprises a plurality of pulleys for guiding the flexible member through the trajectory.

36. The device according to claim 35 wherein said trajectory means further comprises first and second pairs of pulleys, wherein the first pair of pulleys is adapted to accommodate the first substantially vertical branch of the flexible member and wherein the second pair of pulleys is adapted to accommodate the second substantially vertical branch of the flexible member.

37. The device according to claim 17, wherein said first activation means comprises:

a pulley means attached to the lower portion of the latch for contacting the flexible element; and spring means connected to said pulley means for downwardly biasing said pulley means.

38. The device according to claim 17 wherein said trajectory means comprises a pair of lower pulleys disposed inside said housing wherein said lower pulleys for engaging the flexible element, wherein said lower pulleys define in the flexible element a first substantially vertical branch, a substantially horizontal branch located between said lower pulleys, and a second substantially vertical branch.

39. The device according to claim 38 wherein the bottom of said pulley means contacts the substantially horizontal branch of the flexible element.

40. The device according to claim 17 wherein said first activation means comprises spring means.

* * * * *